US006201456B1

(12) United States Patent
Hiratsuka et al.

(10) Patent No.: US 6,201,456 B1
(45) Date of Patent: Mar. 13, 2001

(54) DIELECTRIC FILTER, DIELECTRIC DUPLEXER, AND COMMUNICATION DEVICE, WITH NON-ELECTRODE COUPLING PARTS

(75) Inventors: Toshiro Hiratsuka, Kusatsu; Tomiya Sonoda, Muko; Kenichi Iio, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/181,373

(22) Filed: Oct. 28, 1998

(30) Foreign Application Priority Data

Oct. 28, 1997 (JP) ..... 9-295763
Oct. 6, 1998 (JP) ..... 10-284365

(51) Int. Cl.[7] ..... H01P 1/213; H01P 1/20; H01P 7/10

(52) U.S. Cl. ..... 333/134; 333/202; 333/219.1

(58) Field of Search ..... 333/202, 219.1, 333/126, 129, 132, 134

(56) References Cited

U.S. PATENT DOCUMENTS 5,446,729 * 8/1995 Jachowski ..... 333/126
5,764,116 * 6/1998 Ishikawa et al. ..... 333/219.1 X
5,786,740 * 7/1998 Ishikawa et al. ..... 333/235 X

FOREIGN PATENT DOCUMENTS 734088 9/1996 (EP) .
0 841 714 A1 * 5/1998 (EP) .
10-327002 * 12/1998 (JP) .
11-4108 * 1/1999 (JP) .
1196977 * 12/1985 (SU) ..... 333/219
WO98/26470 * 6/1998 (WO) .

OTHER PUBLICATIONS

Moaund S. et. al. "A new Planar Type Dielectric Resonator for Microwave Filtering" IEEE MTT–S International Microwave Symposium Digest, US, New York, NY: IEEE, 7 Jun. 1998 (1998–06–07), pp. 1307–1310, XP000825036.
Ishkawa Y. et al.: "Planar Type Dielectric Resonator Filter at Millimeter–Wave Frequency" Ieice Transactions on Electronics, JP, Institute Of Electronics Information and Comm. Eng. Tokyo, vol. E79–C, No. 5, 1 May 1996 (1996–05–01), pp. 679–684, XP000621611 ISSN: 0916–8524.

* cited by examiner

*Primary Examiner*—Robert Pascal
*Assistant Examiner*—Barbara Summons
(74) *Attorney, Agent, or Firm*—Ostrolenk, Faber, Gerb & Soffen, LLP

(57) ABSTRACT

A dielectric filter includes electrodes formed on both principal surfaces of a dielectric substrate wherein each electrode has a plurality of openings which are formed so that the locations of the plurality of openings formed in one electrode disposed on one principal surface of the dielectric substrate correspond to the locations of the openings formed in the other electrode disposed on the other principal surface of the dielectric substrate. The dielectric substrate is disposed between upper and lower conductive cases. A non-electrode coupling part is formed between openings thereby coupling resonators with each other or coupling a resonator with input/output means. Thus, the invention provides a resonator which can be easily coupled to another resonator or input/output means and also provides a filter having a wide-band characteristic.

16 Claims, 9 Drawing Sheets

DIELECTRIC FILTER, DIELECTRIC DUPLEXER, AND COMMUNICATION DEVICE, WITH NON-ELECTRODE COUPLING PARTS

BACKGROUND OF THE INVENTION

1. Field of the Invention

The present invention relates to a dielectric filter, a dielectric duplexer, and a communication device for use in the microwave or millimeter wave range.

2. Description of the Related Art

In recent years, with the increasing popularity of mobile communications systems and multimedia, there are increasing needs for high-speed and high-capacity communications systems. As the quantity of information transmitted via these communications systems increases, the frequency range used in communications is being expanded and increased from the microwave range to the millimeter wave range. Although $TE_{01}$ δ-mode dielectric resonators, which are widely used in the microwave range, can also be used in the millimeter waver range, extremely high accuracy is required in production because the resonance frequency of $TE_{01}$ δ-mode dielectric resonators is determined by the outside dimensions of the cylindrical dielectric. However, because of contraction which occurs during the process of firing a dielectric material, it is impossible to produce a cylindrical dielectric having dimensions exactly corresponding to a desired resonance frequency. In the case where a dielectric filter is produced by disposing a plurality of $TE_{01}$ δ-mode dielectric resonators in a metal case so that they are spaced a particular distance apart from each other, a high positioning accuracy is required because the degree of coupling between a dielectric resonator and input/output means such as a metal loop or between dielectric resonators is determined by the distance between these elements.

To solve the above problems, the inventors of the present invention have proposed, in Japanese Unexamined Patent Publication No. 8-265015, a dielectric resonator with a high dimensional accuracy and also a dielectric filter with a high positioning accuracy.

FIGS. 8 and 9 illustrate the basic structure of the dielectric resonator disclosed in the patent application cited above. FIG. 8 is an exploded perspective view of the dielectric filter according to this patent application, and FIG. 9 is a cross-sectional view taken along line X—X of FIG. 8.

As shown in FIGS. 8 and 9, the dielectric filter 110 includes a dielectric substrate 120, an upper conductive case 111, and a lower conductive case 112.

The dielectric substrate 120 is made up of a substrate having a particular relative dielectric constant. One principal surface of the dielectric substrate 120 is entirely covered with an electrode 121*a* except for two circular-shaped openings 122*a* having a particular size formed in the electrode 121*a,* and the other principal surface is entirely covered with an electrode 121*b* except for two circular-shaped openings 122*b* having a particular size formed in the electrode 121*b*. The openings 122*a* and 122*b* are formed at corresponding locations on the opposite principal surfaces.

The upper conductive case 111 is formed of metal in a box shape whose lower side is open. The upper conductive case 111 is disposed near the openings 122*a* of the electrode 121*a* in such a manner that the upper conductive case 111 is spaced by the dielectric substrate 120.

The lower conductive case 112 is made up of a metal plate bent at right angles at both sides. Dielectric strips 113*a* and 113*b* are disposed on both ends of the lower conductive case 112.

The dielectric strips 113*a* and 113*b* are located between the upper conductive case 111 and the lower conductive case 112 so that they act as NRD (non-radiative dielectric) transmission lines. Furthermore, as shown in FIG. 8, the dielectric substrate 120 is disposed on the dielectric strips 113*a* and 113*b* in such a manner that the ends of the respective dielectric strips 113*a* and 113*b* overlap the corresponding openings 122*b* on the other principal surface of the dielectric substrate 120. The dielectric strips 113*a* and 113*b* also serve as spacers by which the dielectric substrate 120 is spaced a fixed distance apart from the inner surface of the bottom of the lower conductive case 112.

In this structure, electromagnetic energy is confined substantially to the portions of the dielectric substrate 120 between the two opposite openings 122*a* and 122*b* formed in the electrodes 121*a* and 121*b,* respectively, and thus these two portions of the dielectric substrate 120 act as resonators. As a result, a dielectric filter having two stages of resonators is obtained.

In the structure described above, the resonance regions are defined by the sizes of the openings formed in the electrodes. Because openings having extremely high dimensional accuracy may be formed for example by means of etching, it is possible to realize a dielectric filter with resonators which are formed with high dimensional accuracy with respect to the resonance frequency and which are positioned with extremely high accuracy relative to each other. Furthermore, in the resonators of the dielectric filter 110, electromagnetic energy is very tightly confined substantially to the portions of the dielectric substrate 120 between the two openings 122*a* and 122*b,* and thus the resonators have high unloaded Q.

However, in the dielectric filter 110, the extremely tight confinement of electromagnetic energy results in weak coupling between adjacent resonators, and the weak coupling between adjacent resonators results in a narrow bandwidth.

More particularly, when the dielectric substrate 120 was made up of a single-crystal sapphire substrate with a thickness of 0.33 mm and a relative dielectric constant of 9.3, the openings 122*a* and 122*b* were formed so that they have a diameter of 3.26 mm and so that the distance between the adjacent openings 122*a* and the distance between the adjacent openings 122*b* are both 0.4 mm, the distance between the ceiling of the upper conductive case 111 and the inner surface of the bottom of the lower conductive case 112 was set to 3.2 mm, the resultant dielectric filter 110 with a center frequency of 60 GHz had a coupling coefficient lower than 0.5% and the rejection band width was as narrow as about 120 MHz.

It is possible to expand the bandwidth of such a filter by decreasing the distance between resonators (the distance between the adjacent openings 122*a* and the distance between the adjacent openings 122*b*) thereby increasing the coupling coefficient. However, in practice, there is a lower limit on the distance between resonators, and more specifically, the practical lower limit is about 0.1 mm. Even when the distance between resonators was reduced to the practical lower limit, the coupling coefficient was still as low as 1.5% and the bandwidth was as narrow as 360 MHz.

When the reduction in the distance between resonators is achieved by reducing the distance between the adjacent openings 122*a* or the distance between the adjacent openings 122*b,* it is required to perform a difficult patterning process on the electrode 121*a* or 121*b*.

Another problem is weak external coupling between the resonators and the input/output NRD dielectric strips 113*a* and 113*b*. To achieve required external coupling, it is required to optimize the positions of the two openings 122*b* formed in the electrodes on the other principal surface of the dielectric substrate 120 relative to the positions of the dielectric strips 113*a* and 113*b*. However, such optimization is difficult.

In view of the above, it is an object of the present invention to provide a resonator that can be easily coupled to an adjacent resonator or to input/output means. It is another object of the present invention to provide a filter having a wide bandwidth.

SUMMARY OF THE INVENTION

According to an aspect of the present invention, there is provided a dielectric filter comprising electrodes formed on both principal surfaces of a dielectric substrate, each electrode having a plurality of openings which are formed so that the locations of the plurality of openings formed in one electrode disposed on one principal surface of said dielectric substrate correspond to the locations of the openings formed in the other electrode disposed on the other principal surface of said dielectric substrate, said dielectric substrate being disposed between upper and lower conductors disposed at opposite locations spaced from said dielectric substrate, parts between the opposite openings serving as resonators, said dielectric filter being characterized in that a non-electrode coupling part for coupling resonators with each other or for coupling a resonator with input/output means is formed at least on one principal surface of said dielectric substrate.

This structure results in an increase in the coupling coefficient between adjacent resonators. As a result, the resultant dielectric filter has a wide passband. The non-electrode coupling part may be formed using the same process as that used to produce the openings, and thus no reduction in productivity occurs.

Preferably, the non-electrode coupling part directly connects at least adjacent openings on one principal surface of the dielectric substrate.

Such a non-electrode coupling part results in an even greater coupling coefficient than can be obtained by a non-electrode coupling part which does not connect openings to each other.

According to another aspect of the present invention, there is provided a dielectric duplexer comprising at least two dielectric filters, input/output coupling means connected to respective said dielectric filters, and antenna connection means connected in common to said dielectric filters, said dielectric duplexer being characterized in that at least one of said dielectric filters is a dielectric filter according to the above-described aspect of the present invention.

According to still another aspect of the present invention, there is provided a communication device comprising a dielectric duplexer according to the above-described aspect of the invention, a transmitting circuit connected to at least one input/output coupling means of said dielectric duplexer, a receiving circuit connected to at least one input/output coupling means different from said input/output coupling means connected to said transmitting circuit, and an antenna connected to the antenna connection means of said dielectric duplexer.

Thus, it becomes possible to easily obtain a dielectric duplexer and a communication device having a wide passband.

DESCRIPTION OF THE PREFERRED EMBODIMENTS

A first embodiment of the present invention is described below.

Figure 1:
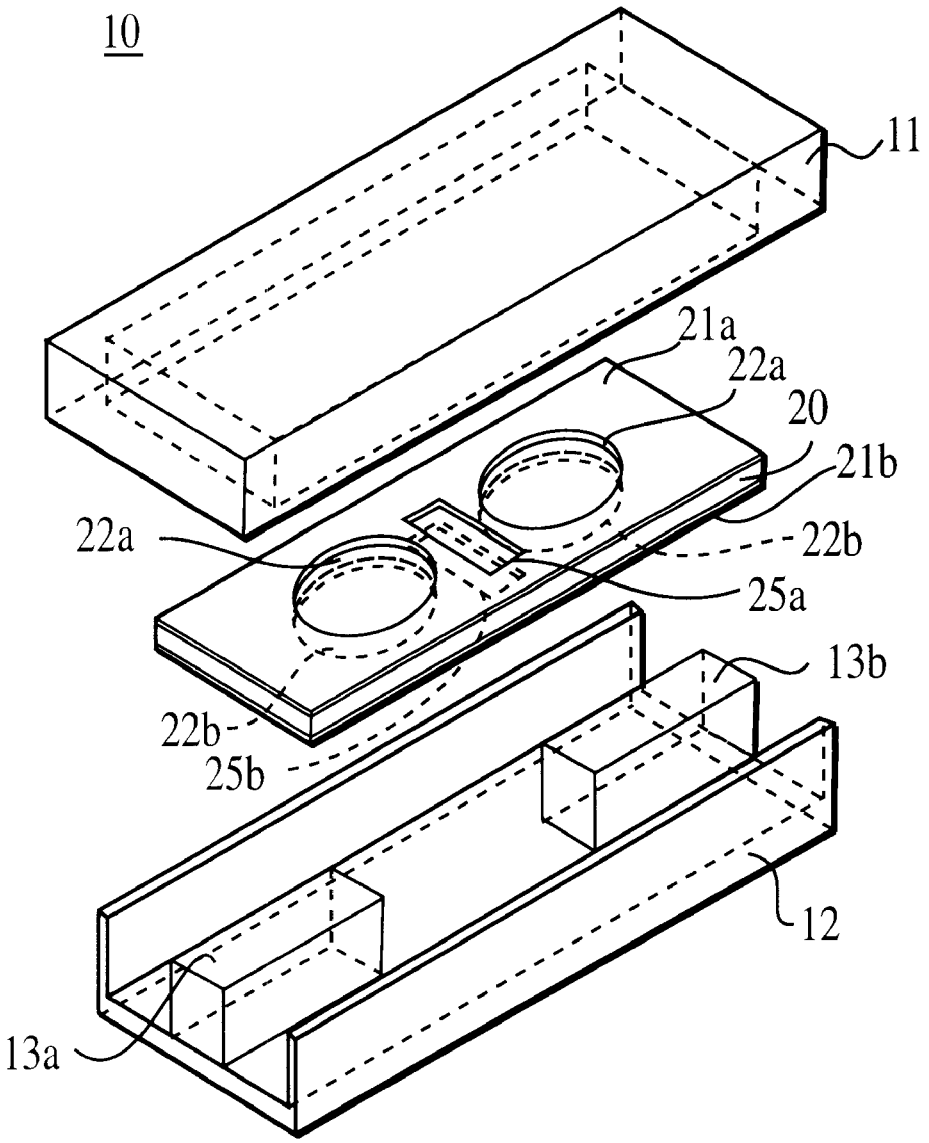
FIG. 1 is an exploded perspective view illustrating a first embodiment of a dielectric filter according to the present invention.

As shown in FIG. 1, a dielectric filter 10 includes a dielectric substrate 20, an upper conductor case 11, and a lower conductor case 12.

The dielectric substrate 20 is made up of a substrate having a particular relative dielectric constant. One principal surface of the dielectric substrate 20 is entirely covered with an electrode 21*a* except for two circular-shaped openings 22*a* having a particular size formed in the electrode 21*a*, and the other principal surface is entirely covered with an electrode 21*b* except for two circular-shaped openings 22*b* having a particular size formed in the electrode 21*b*. The openings 22*a* and 22*b* are formed at corresponding locations on the opposite principal surfaces. An non-electrode coupling part 25*a* is formed between the two openings 22*a* on one principal surface, and a non-electrode coupling part 25*b* is formed between the two openings 22*b* on the other principal surface.

The upper conductive case 11 is formed of metal in a box shape whose lower side is open. The upper conductive case 11 is disposed near the openings 22*a* of the electrode 21*a* in such a manner that the upper conductive case 11 is spaced from the dielectric substrate 20.

The lower conductive case 12 is made up of a metal plate bent at right angles at both sides. Dielectric strips 13*a* and 13*b* are disposed on both ends of the lower conductive case 12 so that the dielectric strips 13*a* and 13*b* act as NRD (non-radiative dielectric) transmission lines and thus act as input/output means, as in the conventional structure.

In the structure described above, electromagnetic energy is partially concentrated on the non-electrode coupling part 25*a* formed between the two openings 22*a* of the electrode 21*a* and also on the non-electrode coupling part 25*b* formed between the two openings 22*b* of the electrode 21*b*. This results in an increase in the coupling between two resonators one of which is formed between one pair of openings 22*a* and 22*b* and the other of which is formed between the other pair of openings 22*a* and 22*b*.

Figure 2:
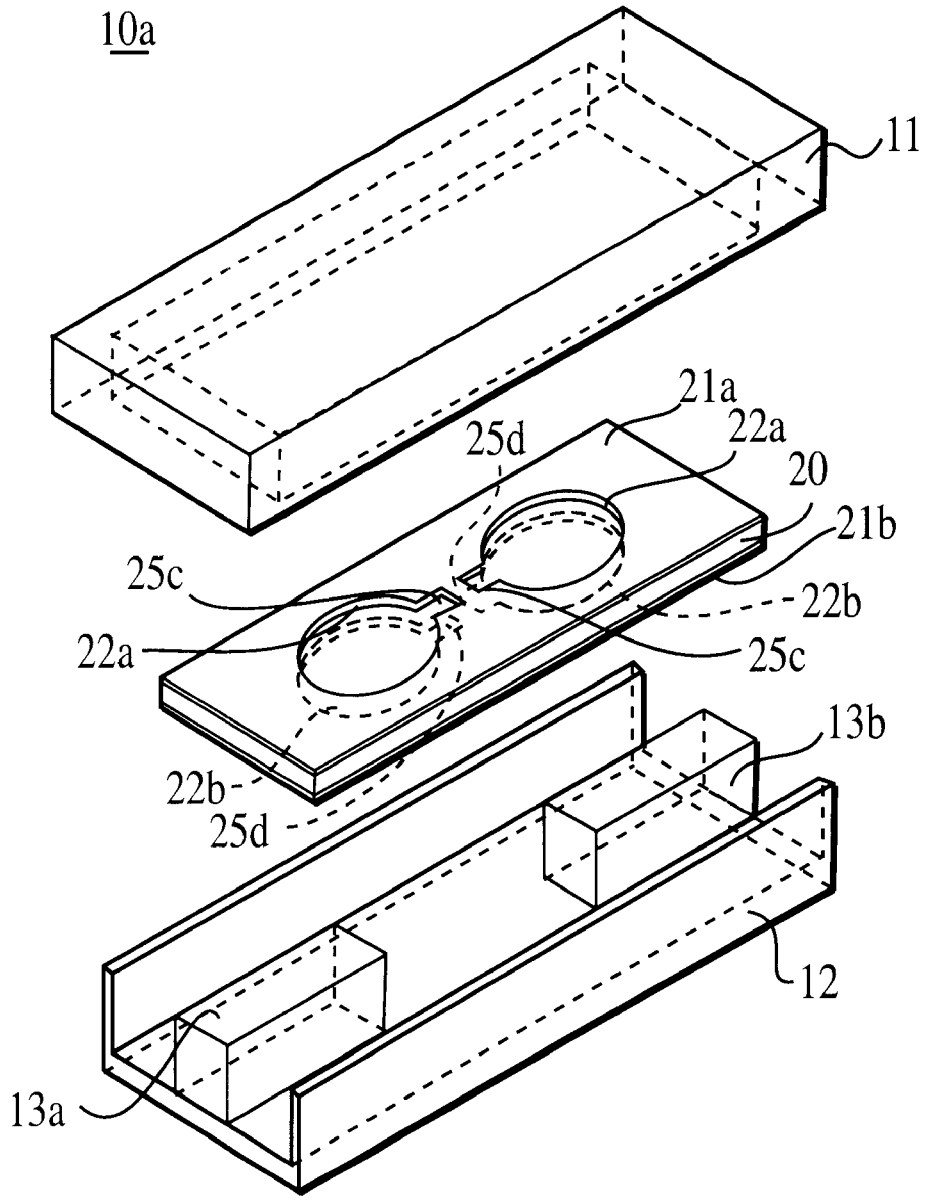
FIG. 2 is an exploded perspective view illustrating a modification of the dielectric filter of the first embodiment.

FIG. 2 illustrates an alternative dielectric filter 10*a* in which each opening 22*a* has an expanded portion serving as a non-electrode coupling part 25*c* extending toward each other and each opening 22*b* has an expanded portion serving as a non-electrode coupling part 25*d* extending toward each other thereby increasing the coupling between the two resonators as in the dielectric filter 10.

Figure 3:
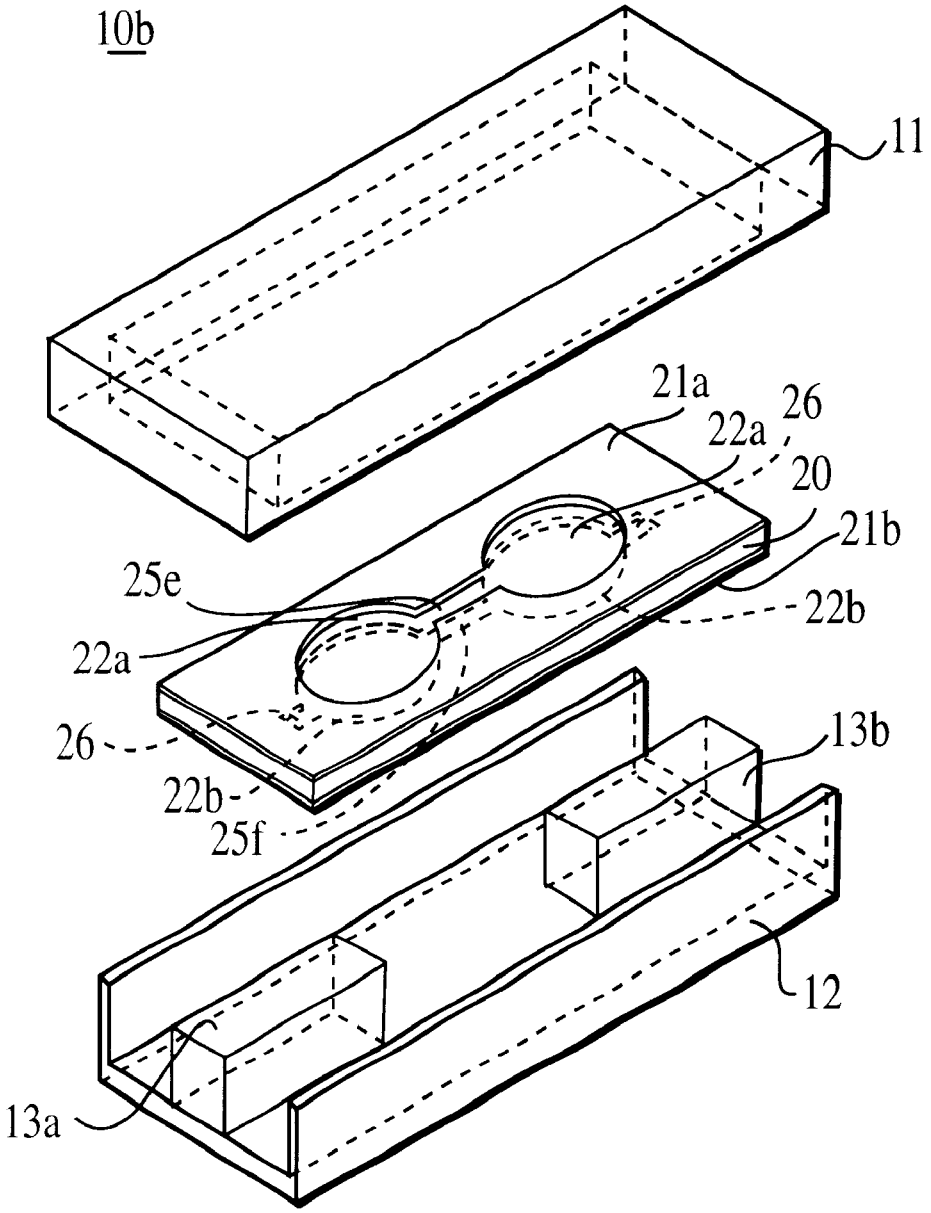
FIG. 3 is an exploded perspective view illustrating a second embodiment of a dielectric filter according to the present invention.

Referring now to FIG. 3, a second embodiment is described below. Similar parts to those of the first embodiment described above with reference to FIG. 1 are denoted by similar reference numerals and they are not described in further detail herein.

In this embodiment, unlike the first embodiment shown in FIG. 1, non-electrode coupling parts are formed on a dielectric substrate in such a manner that adjacent openings formed in electrodes are connected to each other via the non-electrode coupling parts.

That is, as shown in FIG. 3, a non-electrode coupling part 25*e* is formed between two openings 22*a* of an electrode 21*a* on one principal surface of the dielectric substrate 20 so that the two openings 22*a* are connected to each other via the non-electrode coupling part 25*e*. Similarly, a non-electrode coupling part 25*f* is formed between two openings 22*b* of an electrode 21*b* on the other principal surface of the dielectric substrate 20 so that the two openings 22*b* are connected to each other via the non-electrode coupling part 25*f*.

This structure results in stronger coupling between the resonators than can be obtained in the structure according to the first embodiment described above with reference to FIG. 1. Thus, the resultant dielectric filter 10*b* has a greater coupling coefficient.

Another difference of the present embodiment from the first embodiment shown in FIG. 1 is that each opening 22*b* has a notch 26 extending outward. The respective notches 26 are formed so that they are located above the corresponding dielectric strips 13*a* and 13*b*. The notches 26 result in strong coupling with the dielectric strips 13*a* and 13*b* serving as input/output transmission lines.

The non-electrode coupling parts used in the first or second embodiment described above may be formed by means of patterning at the same time as the openings are formed or may be formed by partially removing the electrodes by means of etching or grinding with a grind stone. In the case where the non-electrode coupling parts are formed by means of patterning at the same time as the openings are formed, the coupling coefficient may be adjusted, after the formation of openings, by partially removing the electrodes by means of etching or grinding with a grind stone.

Although in the first and second embodiments, non-electrode coupling parts serving as coupling means are formed on both principal surfaces of the dielectric substrate, a non-electrode coupling part may be formed only on either one principal surface or the other principal surface, depending on the required coupling coefficient.

Although in the first and second embodiment the non-electrode coupling parts serving as coupling means are formed between the openings, the shape, the size, and the location of the non-electrode coupling parts are not limited to those employed in the first or second embodiment but may be modified or adjusted depending on the required coupling coefficient.

Furthermore, although in the first and second embodiments, the filter includes two resonators, the number of resonators is not limited to two. The invention may also be applied to a filter including three or more resonators. The coupling may be exerted not only between adjacent resonators, but in addition a resonator may be coupled with a distant resonator jumping by one or more resonators.

Still furthermore, although in the first and second embodiment, the openings are formed into a circular shape, the shape of the openings is not limited to a circle. The openings may also be formed into an arbitrary shape such as a rectangular shape to achieve similar effects according to the invention.

Still furthermore, although in the first and second embodiment, the input/output transmission lines are realized by NRD transmission lines formed by dielectric strips located between the upper and lower conductive cases, the input/output transmission lines are not limited to such a type. For example, a microstrip line, a loop, or a probe may also be employed as input/output means. In this case, however, unlike the first or second embodiment, the input/output means does not support the dielectric substrate, and thus it is required to support the dielectric substrate using another element such as a spacer.

Figure 4:
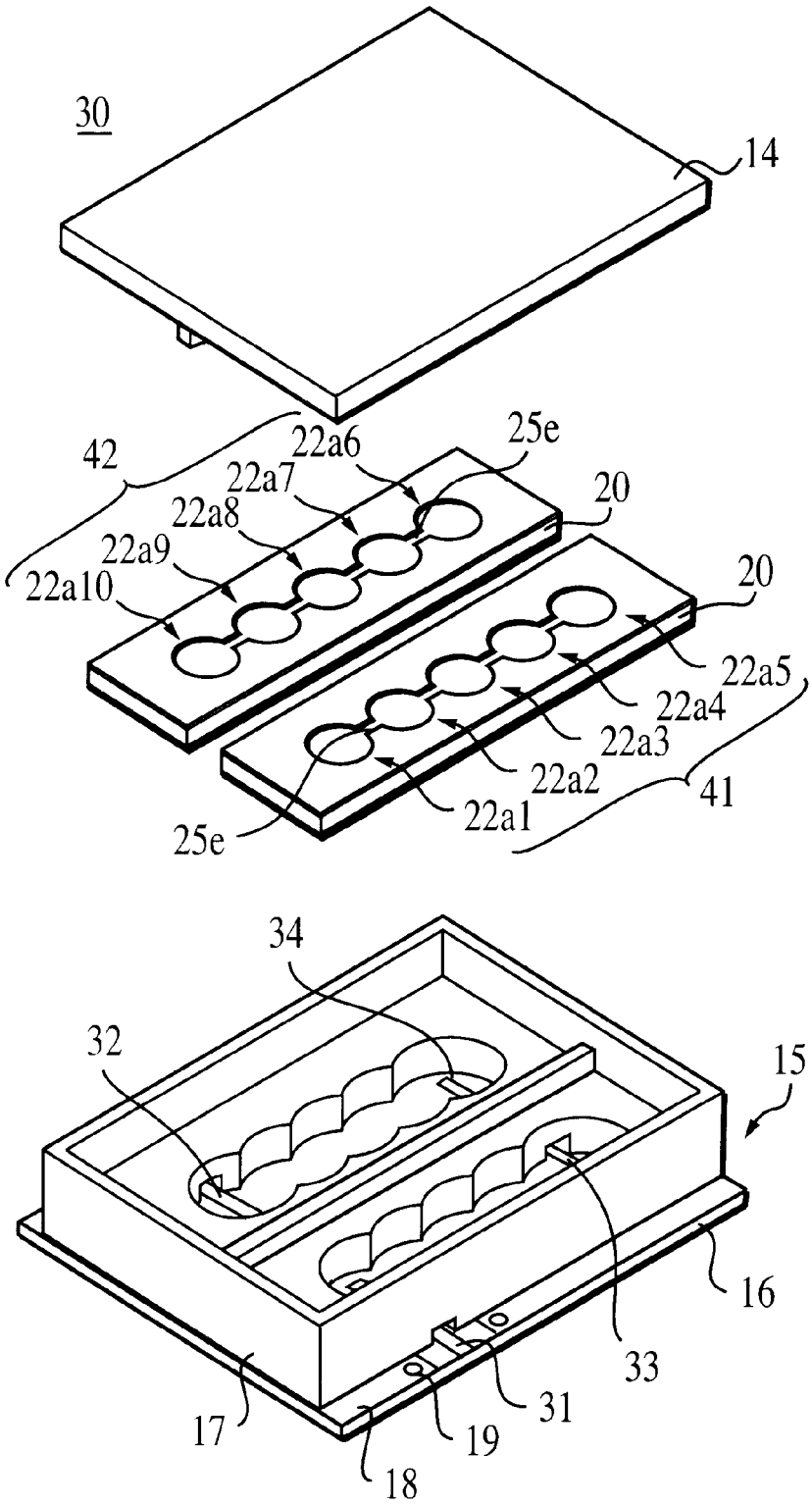
FIG. 4 is an exploded perspective view illustrating a dielectric duplexer according to the present invention.

Referring to FIG. 4, an embodiment of a dielectric duplexer according to the present invention is described below. FIG. 4 is an exploded perspective view of the present embodiment of the dielectric duplexer according to the invention.

As shown in FIG. 4, the dielectric duplexer 30 includes two dielectric substrates 20, an upper case 14, and a lower case 15. An electrode is formed on each of two opposite surfaces of each dielectric substrate 20. Each electrode formed on each dielectric substrate 20 is partially removed so as to form five circular-shaped openings 22*a*1–22*a*5 or 22*a*6–22*a*10. Similar openings are also formed, at corresponding locations, in the electrodes disposed on the back surface of the dielectric substrate. Dielectric resonators are formed by the parts defined by the openings 22*a*1–22*a*5 and 22*a*6–22*a*10 and the upper and lower cases 14 and 15. The resonance frequency of each resonator is determined by the shape of the openings 22*a*1–22*a*5 and 22*a*6–22*a*10, the thickness of the dielectric substrate 20, and other factors.

The lower case 15 includes a base plate 16 and a metal frame 17 disposed on the base plate 16. A step is formed on the inner wall of the metal frame 17 so that the dielectric substrates 20 are placed on the step. An electrode 18 is formed in a predetermined area on the surface of the base plate 16. Input microstrip lines 31 and 34 and output microstrip lines 32 and 33 serving as input and output coupling means, respectively, are also formed on the surface of the base plate 16, in the transmission and reception sections, respectively. The output microstrip line 33 in the transmission section and the input microstrip line 34 in the reception section are connected to a microstrip line (not shown) for connection to an antenna. An electrode is formed substantially over the entire back surface of the base plate 16. To avoid influences of undesired modes, the electrodes formed on the surface of the base plate 16, except for the microstrip lines 31–34, are electrically connected via a through-hole 19 to the electrode formed on the back surface of the base plate 16.

In the dielectric duplexer 30 having the structure described above, the dielectric substrates 20 are placed on the step formed on the inner wall of the lower case 15 and fixed to it via a conductive adhesive or the like. The upper case 14 is firmly placed on the metal frame 17 of the lower case 15.

The dielectric duplexer 30 according to the present embodiment includes a first dielectric filter 41 including dielectric resonators formed by five openings 22*a*1–22*a*5 on the dielectric substrate 20 and a second dielectric filter 42 including dielectric resonators formed by another five openings 22a6–22a10. The five dielectric resonators of the first dielectric filter 41 are magnetically coupled with each other so that they act as a transmission bandpass filter. The five dielectric resonators of the second dielectric filter 42 have resonance frequencies different from those of the dielectric resonators of the first dielectric filter, and they are also magnetically coupled with each other so that they act as a reception bandpass filter. The microstrip line 31 coupled with the dielectric resonator at the input stage of the first dielectric filter is connected to an external transmitting circuit. The microstrip line 32 coupled with the dielectric resonator at the output stage of the second dielectric filter is connected to an external receiving circuit. The microstrip line 33 coupled with the dielectric resonator at the output stage of the first dielectric filter 41 and the microstrip line 34 coupled with the dielectric resonator at the input stage of the second dielectric filter 42 are connected in common to a microstrip line serving as antenna connecting means connected to an external antenna.

In the dielectric duplexer 30 constructed in the above-described manner, the first dielectric filter 41 passes a signal having a predetermined frequency. The diameters of the circular-shaped openings of the second dielectric filter 42 are set to values different from those of the first dielectric filter so that the second dielectric filter 42 passes a signal having a frequency different from the former frequency. As a result, the dielectric duplexer 30 acts as a bandpass dielectric duplexer.

A partition bar is provided in the upper case 14 and another partition bar is provided in the lower case 15 in such a manner that each partition bar is located between the first dielectric filter 41 and the second dielectric thereby isolating them from each other.

In the dielectric duplexer 30 of the present embodiment, as in the second embodiment, non-electrode coupling parts 25e are formed so that the five openings 22a1–22a5 and 22a6–22a10 formed on the dielectric substrates 20 are connected to each other via the non-electrode coupling parts 25e thereby increasing the coupling between adjacent dielectric resonators thus achieving a wide-band dielectric duplexer.

Other examples of dielectric duplexers according to the present invention are described below with reference to FIGS. 5 and 6. Similar parts to those in the previous embodiments are denoted by similar reference numerals and they are not described in further detail herein.

Figure 5:
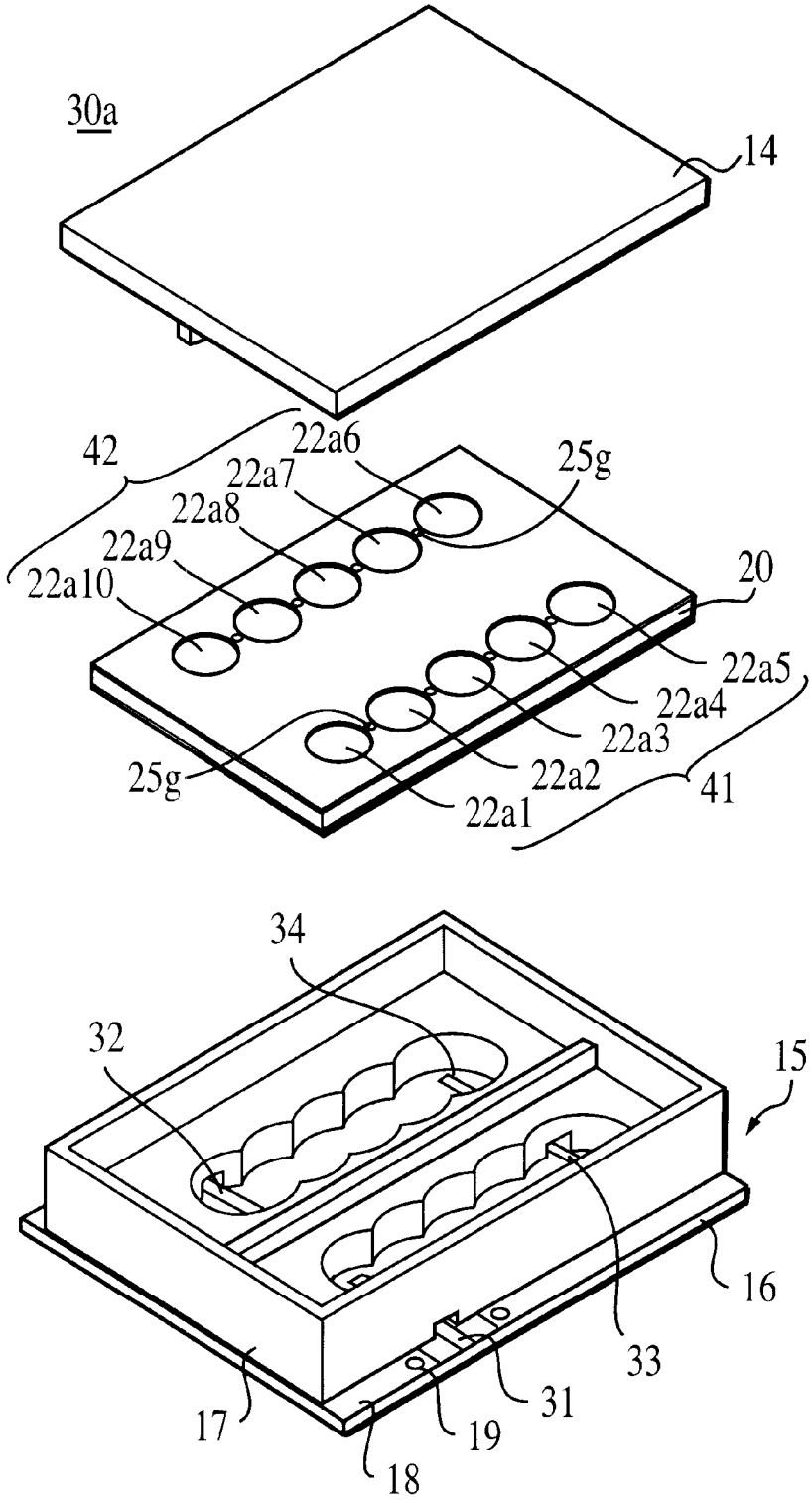
FIG. 5 is an exploded perspective view illustrating another dielectric duplexer according to the present invention.

In the dielectric duplexer 30a shown in FIG. 5, five circular-shaped openings 22a1–22a5 and another five circular-shaped openings 22a6–22a10 are formed on a dielectric substrate 20, and circular-shaped non-electrode coupling parts 25g are formed between adjacent openings of five circular-shaped openings 22a1–22a5 also between adjacent openings of five circular-shaped openings 22a6–22a10. Unlike the previous embodiment in which transmission and reception sections have their own separate dielectric substrate, the dielectric duplexer 30a shown in FIG. 5 has a single dielectric substrate 20 on which both transmission and reception sections are formed.

Figure 6:
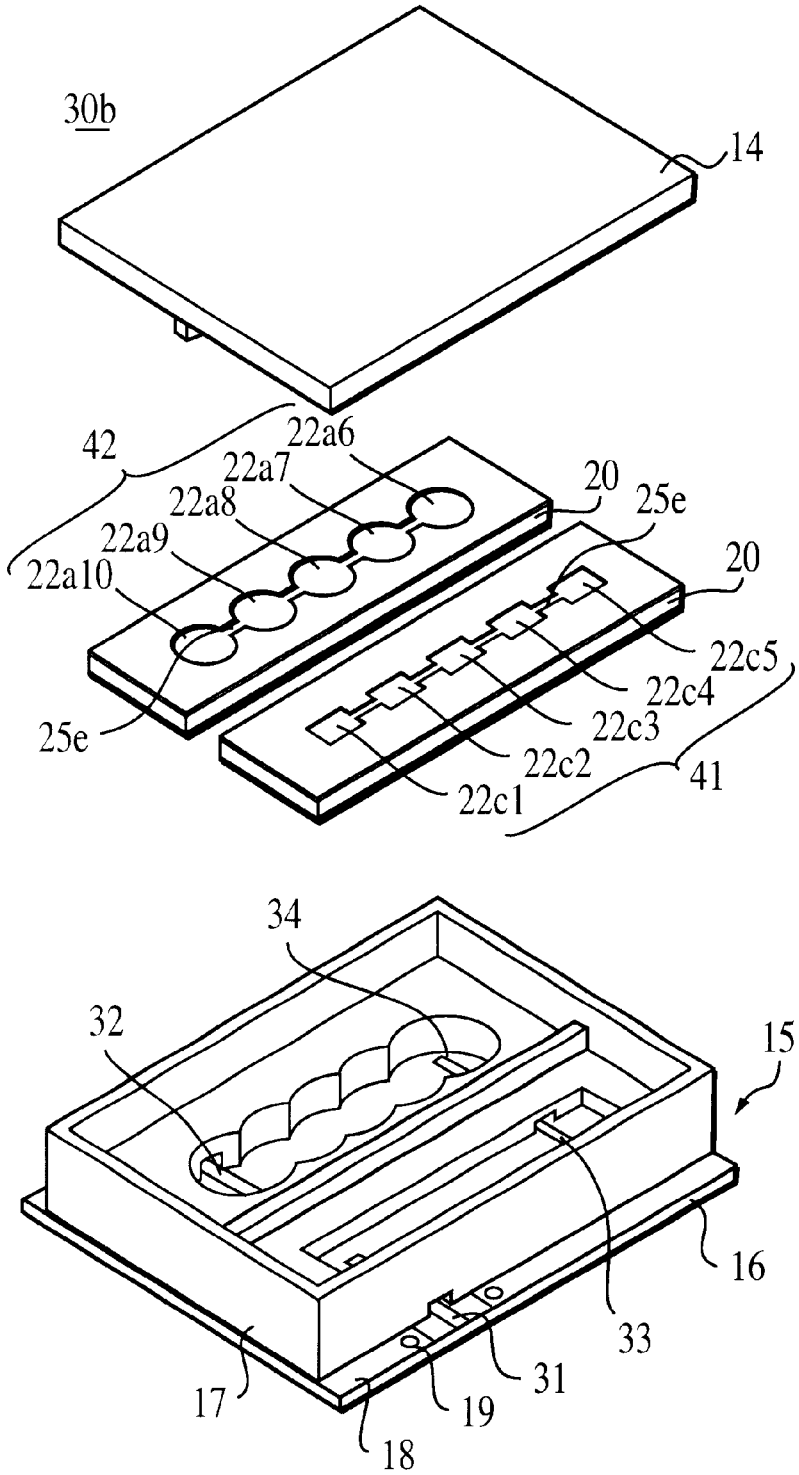
FIG. 6 is an exploded perspective view illustrating still another dielectric duplexer according to the present invention.

In the dielectric duplexer 30b shown in FIG. 6, circular-shaped openings 22a6–22a10 are formed on a dielectric substrate 20 in a reception section and rectangular-shaped openings 22c1–22c5 are formed on a dielectric substrate 20 in a transmission section. Therefore, resonance occurs in a $TE_{010}$ mode for the dielectric resonators formed by the openings 22a6–22a10 on the dielectric substrate 20 in the reception section, and resonance occurs in a rectangular slot mode for the dielectric resonators formed by the openings 22c1–22c5 on the dielectric substrate 20 in the transmission section. Non-electrode coupling parts 25e are formed so that five openings 22a6–22a10 and also five openings 22c1–22c5 formed on the respective dielectric substrates 20 are connected to each other via the non-electrode coupling parts 25e.

Figure 7:
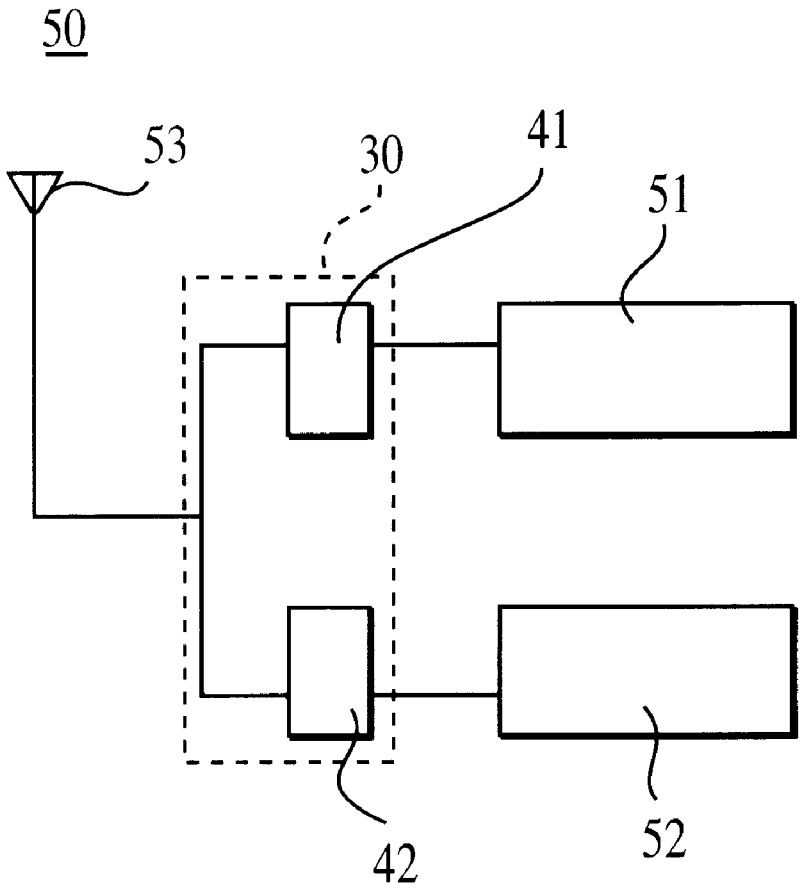
FIG. 7 is a schematic diagram illustrating a communication device according to the present invention.
Figure 8:
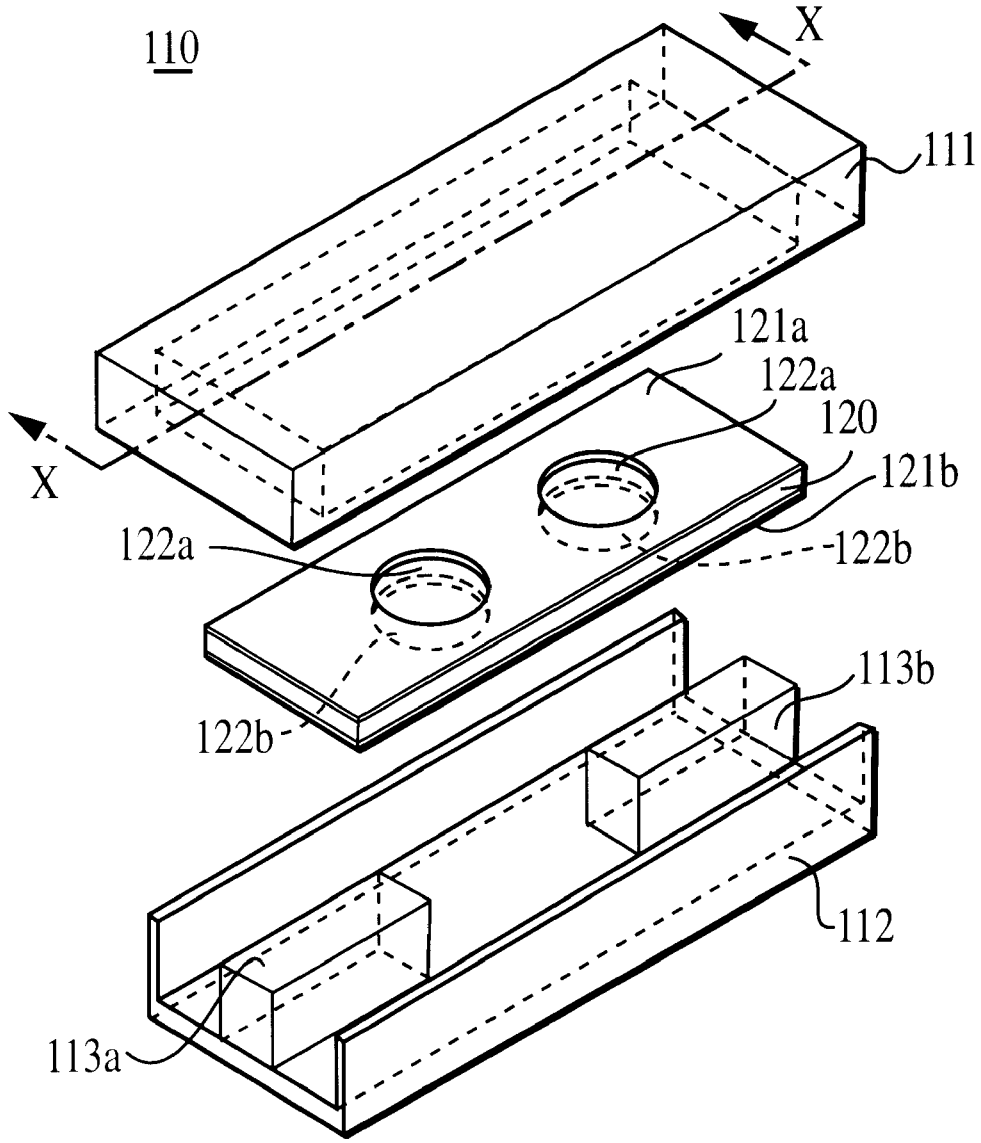
FIG. 8 PRIOR ART
FIG. 8 is an exploded perspective view illustrating a dielectric filter which has been proposed by the inventors of the present invention.
Figure 9:
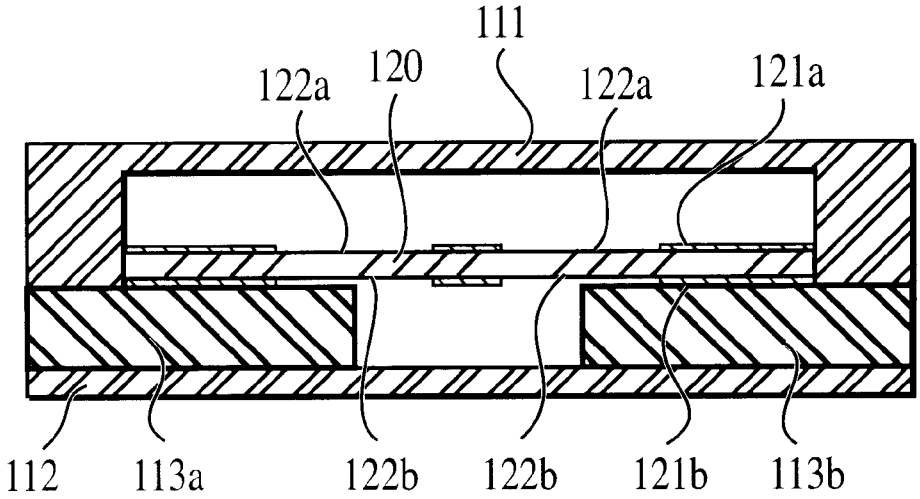
FIG. 9 PRIOR ART
FIG. 9 is a cross-sectional view taken along the line X—X of FIG. 8.

Referring now to FIG. 7, an embodiment of a communication device according to the present invention is described below. FIG. 7 is a schematic diagram illustrating the communication device according to the present embodiment.

As shown in FIG. 7, the communication device 50 of the present embodiment includes a dielectric duplexer 30, a transmitting circuit 51, a receiving circuit 52, and an antenna 53. Herein, the dielectric duplexer according to the previous embodiment is employed as the duplexer 30. The input/output coupling means connected to the first dielectric filter 41 shown in FIG. 6 is connected to the transmitting circuit 51. The input/output coupling means connected to the second dielectric filter 42 is connected to the receiving circuit 52. The antenna connecting means is connected to the antenna.

As can be understood from the above description, the present invention has various advantages. That is, the dielectric filter according to the present invention has an increased coupling coefficient between adjacent resonators and thus the dielectric filter has a wide-band characteristic. The coupling coefficient can be increased simply by forming a non-electrode coupling part and thus it is easy to increase the coupling coefficient as opposing to the conventional technique in which the coupling coefficient is increased by forming openings at closer locations.

In particular, when openings forming respective resonators are connected to each other via a non-electrode coupling part, the resultant dielectric filter has a still greater coupling coefficient between resonators than can be obtained with openings which are not directly connected to each other.

What is claimed is:

1. A dielectric filter comprising electrodes formed respectively on both principal surfaces of a dielectric substrate, each electrode having a plurality of openings which are formed so that the locations of the plurality of openings formed in one electrode correspond to the locations of the openings formed in the other electrode, said dielectric substrate being disposed between upper and lower conductors disposed at opposite locations spaced from said dielectric substrate, parts between the opposite openings serving as resonators, said dielectric filter having a non-electrode coupling part which is disposed at least on one principal surface of said dielectric substrate so as to couple resonators with each other.

2. A dielectric filter according to claim 1, wherein said non-electrode coupling part comprises at least one first slot formed in said one electrode and disposed between a pair of said openings on said one principal surface.

3. A dielectric filter according to claim 2, further comprising at least one second slot formed in the other said electrode and disposed on the other principal surface at a location corresponding to said at least one first slot.

4. A dielectric filter according to claim 1, wherein said non-electrode coupling part comprises a pair of slots formed in said one electrode and extending toward each other from a respective pair of said openings on said one principal surface.

5. A dielectric filter according to claim 4, further comprising a second pair of slots formed in the other said electrode and extending toward each other from the respective pair of said openings on the other principal surface.

6. A dielectric filter according to claim 1, further comprising an input/output non-electrode coupling part disposed on at least one principal surface of said dielectric substrate so as to couple resonators with input/output waveguides.

7. A dielectric filter according to claim 6, wherein said input/output non-electrode coupling part comprises a pair of slots formed in said one electrode and extending away from each other and from a respective pair of said openings on said one principal surface.

8. A dielectric filter according to claim 7, wherein said non-electrode coupling part directly connects adjacent openings on an opposite principal surface of said dielectric substrate from said input/output non-electrode coupling part.

9. A dielectric filter according to claim 8, wherein said non-electrode coupling part further directly connects adjacent openings on said one principal surface of said dielectric substrate.

10. A dielectric filter according to claim 6, wherein said non-electrode coupling part directly connects adjacent openings on an opposite principal surface of said dielectric substrate from said input/output non-electrode coupling part.

11. A dielectric filter according to claim 10, wherein said non-electrode coupling part further directly connects adjacent openings on said one principal surface of said dielectric substrate.

12. A dielectric filter comprising electrodes formed respectively on both principal surfaces of a dielectric substrate, each electrode having a plurality of openings which are formed so that the locations of the plurality of openings formed in one electrode correspond to the locations of the openings formed in the other electrode, said dielectric substrate being disposed between upper and lower conductors disposed at opposite locations spaced from said dielectric substrate, parts between the opposite openings serving as resonators, said dielectric filter having a non-electrode coupling part disposed for coupling resonators with each other or for coupling a resonator with input/output means is formed at least on one principal surface of said dielectric substrate, wherein said non-electrode coupling part directly connects adjacent openings on one principal surface of said dielectric substrate.

13. A dielectric filter according to claim 12, wherein said non-electrode coupling part also directly connects adjacent openings on the other said principal surface of said dielectric substrate.

14. A dielectric duplexer comprising at least two dielectric filters, input/output connectors connected to respective said dielectric filters, and an antenna connector connected in common to said dielectric filters, said dielectric duplexer being characterized in that at least one of said dielectric filters is a dielectric filter according to claim 1 or claim 12.

15. A communication device comprising a dielectric duplexer according to claim 14, a transmitting circuit connected to at least one input-output connector of said dielectric duplexer, and a receiving circuit connected to at least one input-output connector different from said input/output connector connected to said transmitting circuit.

16. A communication device according to claim 15, further comprising an antenna connected to the antenna connector of said dielectric duplexer.

* * * * *